US005271086A

United States Patent [19]

Kamiyama et al.

[11] Patent Number: 5,271,086

[45] Date of Patent: Dec. 14, 1993

[54] QUARTZ GLASS TUBE LIQUID HEATING APPARATUS WITH CONCENTRIC FLOW PATHS

[75] Inventors: Toshihisa Kamiyama, Tokyo; Masanori Kawaguchi, Takasago; Tetsuo Takehara, Tokyo, all of Japan

[73] Assignee: Asahi Glass Company Ltd., Tokyo, Japan

[21] Appl. No.: 825,559

[22] Filed: Jan. 24, 1992

[30] Foreign Application Priority Data

Jan. 24, 1991 [JP] Japan ..... 3-022654

[51] Int. Cl.[5] ..... F24H 9/18

[52] U.S. Cl. ..... 392/483; 392/482; 392/480; 137/341; 165/154

[58] Field of Search ..... 392/483, 482, 480; 422/22, 109, 307–308; 137/340, 341; 165/104.19, 104.28, 154–156

[56] References Cited

U.S. PATENT DOCUMENTS

| | | | |
|---|---|---|---|
| 2,446,367 | 8/1948 | Graves | 392/483 |
| 4,192,988 | 3/1980 | Pederson, Jr. et al. | 422/22 |
| 4,286,140 | 8/1981 | Dewulf et al. | 392/483 |
| 4,371,777 | 2/1983 | Roller et al. | 219/505 |
| 4,384,578 | 5/1983 | Winkler | 604/114 |
| 4,728,776 | 3/1988 | Vincent | 392/483 |

FOREIGN PATENT DOCUMENTS

| | | | |
|---|---|---|---|
| 1271854 | 7/1968 | Fed. Rep. of Germany | 392/480 |
| 981040 | 5/1951 | France | 392/480 |
| 57-204744 | 12/1982 | Japan . | |
| 63-307682 | 12/1988 | Japan . | |
| 1-98854 | 4/1989 | Japan . | |
| 1009405 | 4/1983 | U.S.S.R. | 392/483 |

*Primary Examiner*—Bruce A. Reynolds
*Assistant Examiner*—John A. Jeffery
*Attorney, Agent, or Firm*—Oblon, Spivak, McClelland, Maier & Neustadt

[57] ABSTRACT

A liquid heating apparatus 1 has a flow path 2 surrounded by a quartz glass tube 5 inside a tubular ceramic heater 4 which radiates infrared rays and has a PTC characteristic, and a flow path 3 which is formed between two quartz glass tubes 6, 7 which are disposed outside the tubular ceramics tube 4 in a coaxial manner. The liquid heating apparatus can effectively heat purified water used for manufacturing electronics-related products without contamination of the purified water, and provides a compact size while having a high heat capacity.

9 Claims, 5 Drawing Sheets

QUARTZ GLASS TUBE LIQUID HEATING APPARATUS WITH CONCENTRIC FLOW PATHS

The present invention relates to a liquid heating apparatus for continuously heating liquid to be heated such as purified water without causing contamination and with a high efficiency, which can be compact even under a high load operation.

There have been demands in various industrial fields to a liquid heating apparatus which is able to heat a liquid to be heated with a high thermal efficiency and without causing contamination due to impurities eluted from the wall of a flow path for the liquid and small particles or dust, and can be compact even under a high load operation, and is economical.

As conventional electric resistance heating type liquid heating apparatuses, there have been known such types as a rod-like heater, a plate-like heater and a sheathed coil heater which are immersed in the liquid to be heated, and such a type as a heater to be embedded in the wall of the liquid bath.

For instance, in the case of an immersion type heater, there is a type with a nichrome wire enclosed in a quartz glass tube. Recently, there have been proposed a type with a positive electric resistance temperature coefficient (PTC) characteristics wherein liquid is passed through a honeycomb ceramic heater and a type with a flow path for liquid to be heated is in close-contact with a plate-like electric heater.

For instance, Japanese Unexamined Patent Publication No. 204744/1982 discloses an electric heating apparatus for water with a cylindrical heating element which is prepared by vapor-depositing a resistance heating material on the inner and outer surfaces of a tubular ceramic substrate and by covering the resistance heating material with a thin insulating ceramic sheet so as to utilize the inner and outer surfaces of the tubular heating element, and water is introduced to produce a spiral flow in a flow path formed at the outer side of the tubular heating element whereby heat exchange efficiency is increased and a temperature distribution of the heating element is uniformed. When a liquid to be heated is an electric conductive liquid such as water or an electrolyte solution, an insulating material should be lined on the walls of the flow path for the liquid to be heated so that the liquid is insulated from the heater.

Japanese Unexamined Patent Publication No. 98854/1989 discloses an electric type instantaneous water heater having coaxially arranged three cylindrical tubes to form first, second and third spaces counted from the inner side toward outer side wherein an arc plasma is generated in the second space having a cylindrical shape and the heat of the arc plasma is transferred to water which flows the first and third spaces. Although the publication is silent about material on these tubes, it is considered that the material of the two tubes disposed at the inner side for generating the arc plasma is an electric conductive material.

Recently, there has been a trend to use a purified water which is chemically and physically refined instead of flons for washing intermediate products of electronic devices such as semiconductor devices, and there are increasing needs for a liquid heating apparatus capable of heating purified water without causing contamination.

However, a conventional liquid heating apparatus using a rod-like or a wire-like heater element has such a disadvantage that a calorific value is limited because it is difficult to obtain a sufficient heat transfer surface area between the liquid and the heater element, and in order to obtain a sufficient heat transfer surface area, a number of heaters has to be used or a long heater has to be used, and therefore it is difficult to make the entire size of the liquid heating apparatus having a high calorific value compact.

In a case of using a conventional small-sized plate-like heater, it is difficult to increase the calorific value of the heater, and accordingly, it is difficult to realize a compact liquid heating apparatus having a high calorific value.

Further, in a case of using a honeycomb ceramic heater, there is a disadvantage that the thermal efficiency becomes small for an amount corresponding to the dissipation of heat from the circumference of the honeycomb ceramic heater.

Further, there is a problem of electric leakage when an electric conductive liquid such as water or an electrolyte solution is to be heated. In this respect, a method of inserting insulating tubes in the through holes in the honeycomb ceramic heater to insulate the liquid from the heater is possible. However, the honeycomb heater has a number of through holes into which the insulating tubes have to be inserted, and it is indispensable to connect the large number of tubes at both ends of the tubes. Accordingly, connecting work is troublesome and takes much labor, so that it is impossible to manufacture a liquid heating apparatus at a reduced cost.

Further, as in the case of heating ultra-purified water, there is a strong demand for a liquid heating apparatus capable of heating purified water without causing contamination. However, if a conventional immersion type heater is used, the total volume of a liquid heating apparatus becomes too large to maintain the temperature of a considerable amount of water in a water bath at a predetermined temperature and it takes much lead time to obtain purified water having a predetermined temperature, and thermal efficiency is not good. Therefore, there is a strong demand for a liquid heating apparatus capable of heating purified water without causing contamination, having good thermal efficiency, having a compact configuration with a high load capacity, capable of being easily handled and being supplied at an economical cost.

Figure 1:
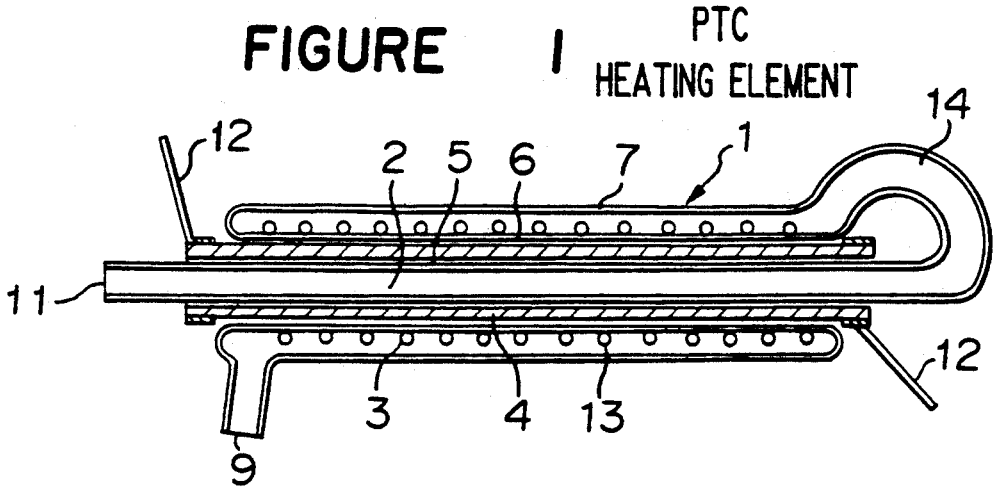
FIG. 1 is a cross-sectional view of an embodiment of the liquid heating apparatus of the present invention.

In accordance with the present invention, there is provided a liquid heating apparatus comprising an electric resistance heating type ceramic heater having a tubular shape, first and second flow paths for flowing liquid to be heated, which are formed in the vicinity of the inside and the outside of said tubular ceramic heater respectively, wherein said first flow path for the liquid is surrounded by a first quartz glass tube which is disposed inside said tubular ceramic heater in a coaxial manner, and said second flow path for the liquid is formed between second and third quartz glass tubes which are disposed outside said tubular ceramic heater in a coaxial manner.

In the present invention, the quartz glass is such one as being obtained by melting quartz crystals having a high purity to form glass, or silica glass made from pure silica obtained by the hydrolysis reaction of silicon tetrachloride ($SiCl_4$) or the like.

In the liquid heating apparatus of the present invention, since the flow paths for the liquid to be heated are formed in the vicinity of the inside and the outside of the electric resistance heating type ceramic heater having a tubular shape, the inner and outer surfaces of the tubular ceramic heater are utilized as heat transfer surfaces; hence, a large heat transfer surface area can be obtained. Further, since heat transfer to the liquid to be heated is made by effectively utilizing both a heat conduction through the wall of the quartz glass tube and a radiation heat transfer through the wall of the quartz glass tube due to heat radiation from the tubular ceramic heater, excellent heat transfer can be obtained. In addition, since the heat generating portion of the tubular ceramic heater is almost completely surrounded by the flow paths for the liquid to be heated, almost all heat generated from the inner and outer surfaces of the heater can be transferred to the liquid to be heated, and excellent thermal efficiency is obtainable.

Since the liquid heating apparatus of the present invention has such structure that the inner and outer surfaces of the tubular ceramic heater are insulated by the quartz glass from the liquid to be heated, it can be used even when an electric conductive liquid such as water or a water solution is to be heated.

Further, in the liquid heating apparatus of the present invention, the flow paths for the liquid are entirely formed of the quartz glass which is durable to a corrosive liquid except for hydrofluoric acid. Further, the quartz glass is a material which does not cause contamination of the liquid with impurities and small particles, and commercial quartz glass having a high purity is easily available. Accordingly, it is possible to provide a liquid heating apparatus suitable for heating ultra-purified water used for manufacturing semiconductors and capable of heating ultra-purified water without contamination, at a relatively low cost.

The quartz glass is durable to corrosion by acid. Accordingly, even when the flow path is contaminated, it can be regenerated by washing it with acid. Further, the quartz glass has a sufficient heat resistance required for a material disposed in the vicinity of the ceramic heater for the liquid heating apparatus and has an extremely small thermal expansion coefficient, whereby it can not be broken even when it suffers rapid heating or cooling in use. Further, since it can transmit infrared rays, a large amount of radiation emitted from the ceramic heater can be effectively utilized for heat transfer, and accordingly, the quartz glass can in particular be suitable for the liquid heating apparatus of the present invention as a wall material for the flow paths used adjacent to the ceramic heater as a heating source.

However, the quartz glass tends to cause devitrification (crystallization) to thereby change its properties when it is heated at 700° C. or more for a long time. Accordingly, service temperature should not be so high. When the devitrification is resulted, small particles are emitted to thereby cause contamination of the liquid to be heated. Accordingly, it is preferable that the service temperature of the tubular ceramic heater is kept about 600° C. or lower.

As a material possibly used for the walls of flow paths except for the quartz glass, there are fluoro resins such as polytetrafluoroethylene (PTFE) and heat resistant glasses such as borosilicate glass. However, it is unavoidable that a small amount of organic material elutes from the PTFE into heated purified water and at the same time, small particles are emitted. Accordingly, the PTFE is unsuitable for the purpose of heating purified water.

Further, since the heat resistance property of the PTFE is as low as up to 300° C. and the thermal conductivity is not so good, it is difficult to increase the temperature of the tubular ceramic heater disposed in the vicinity of the flow paths. Accordingly, a liquid heating apparatus operable without causing contamination of the liquid to be heated, and having a compact size and a high calorific value can not be realized so long as the PTFE is used as a wall material for the flow paths.

When borosilicate glass whose heat resistance is as low as about 600° C. is used for the wall material of the flow path for the liquid to be heated, the temperature of the tubular ceramic heater is limited to be low. Further, since the thermal expansion coefficient of the borosilicate glass, which is said to be small, is far larger than that of the quartz glass, thermal stress-cracking may take place when it is rapidly heated or cooled. Further, although the borosilicate glass has relatively good corrosion resistance, it can not prevent emission of a small amount of impurities and small particles when the temperature of the liquid to be heated becomes high. Accordingly, it can not be used except for a limited use where small amounts of impurities and small particles are allowed.

In a preferred embodiment of the liquid heating apparatus of the present invention, the material of the tubular ceramic heater is composed of silicon and a metal oxide including alumina and silica as major components wherein the content of the free silicon in the material is in a range of from 5 to 50% by weight.

Since the material of the tubular ceramic heater includes free silicon and the metal oxide as the major components wherein the content of the free silicon is 5–50% by weight, the electric resistance of the material of the ceramics heater assumes a positive electric resistance temperature coefficient, which allows the heater to heat to about 600° C. whereas a conventional heater made of barium titanate PTC material (ceramics whose electric resistance temperature coefficient is a positive number) can not be heated to above 300° C. owing to its PTC characteristics. Further, since the material comprising the silicon and the metal oxide constitutes a heater element whose electric resistance temperature coefficient is a positive number, the electric resistance increases upon temperature rise, which eliminates a danger of the over-heating of the heater. Accordingly there is obtainable a liquid heating apparatus in which temperature control is easy.

The content of free silicon determines the electric resistance characteristic of the ceramic heater. Accordingly, the metallic silicon content is preferably in a range of 5–50% by weight in order to obtain a ceramic heater having an easily usable electric resistance characteristic.

The ceramic heater of the above-mentioned silicon content radiates a large amount of infrared rays including far infrared rays which can pass through a quartz glass wall surrounding a flow path for liquid, and are absorbed by water or a water solution. Accordingly, when water or a water solution is to be heated, the heat radiation can be effectively utilized for heat transfer, and a liquid heating apparatus having excellent heating efficiency can be realized by using the quartz glass as the wall material of the flow path.

In another embodiment of the liquid heating apparatus of the present invention, the flow path formed outside the tubular ceramic heater and the flow path inside the same are connected in series by means of a connecting tube. Such structure that the inner and outer flow paths are connected in series can broaden the possible temperature range of the liquid to be heated.

In a case of washing silicon wafers or magnetic disk substrates, a purified water temperature of 80° C. is considered to be desirable in order to finish quickly to dry articles after the washing. If a plurality of the liquid heating apparatuses are connected in series, it is easy to heat the purified water to such a temperature. According to this embodiment, a liquid heating apparatus easy to use and having wide application can be provided. In accordance with another embodiment of the present invention, the temperature of the liquid to be heated is regulated by controlling electric power so that the temperature of the tubular ceramic heater is maintained to a predetermined temperature on the basis of a temperature signal from a temperature sensor disposed at an inlet port of the liquid, a temperature signal from a temperature sensor attached to the tubular ceramic heater, and a flow rate signal from a flow sensor disposed at an inlet pipe for the liquid to fed to the liquid heating apparatus. Namely, since the second temperature sensor is attached to the tubular ceramic heater, the temperature of the tubular ceramic heater is directly detected whereby the temperature of the heater can be directly controlled.

The temperature control of the tubular ceramic heater to a predetermined temperature in consideration of the flow rate of the liquid to be heated and the temperature of the liquid at the inlet port is carried out as follows. The hold-on temperatures of the tubular ceramic heater to be heated are previously collected as data, through experiments, for instance, on the basis of the temperature of the liquid at the inlet port and the flow rates of the liquid as well as the temperatures of the liquid to be heated, and the hold-on temperature of the tubular ceramic heater is determined to obtain a desired temperature for the liquid on the basis of the data thus obtained, whereby the temperature of the liquid discharged from the liquid heating apparatus can be quickly controlled to have a desired temperature.

There are several ways to control the temperature of the liquid at the outlet port of the liquid heating apparatus since there are some parameters. Although there are such phenomena depending on ways to be taken that a certain time is needed in which the temperature of the liquid at the outlet port converges to a desired temperature, and that the temperature of the liquid at the outlet port is oscillated due to a change of one of the parameters, such phenomena can be eliminated by directly controlling the temperature of the tubular ceramic heater.

The temperature control is preferably carried out with use of a microcomputer. For instance, data on the temperatures of the tubular ceramic heater which correspond to the flow rates, the temperatures at the entrance of the liquid to be heated and the temperatures of the heated liquid are previously stored in the memory of the microcomputer, and electric power to be supplied is controlled so that the temperature of the tubular ceramic heater becomes a predetermined temperature determined on the basis of the collected data whereby the outflow temperature of the liquid at the outlet port can be quickly adjusted to a desired temperature.

In a case that these data are not previously collected, the temperature of the liquid discharged from the liquid heating apparatus may be monitored so that the temperature of the heated liquid is controlled to a desired temperature, although this method requires a certain lead time.

In another preferred embodiment of the liquid heating apparatus of the present invention, a core tube formed of a hollow quartz glass tube is put in a flow path formed of a first quartz glass tube which is disposed inside the tubular ceramic heater, and an impeller is fixed to the circumference of the core tube at a position near its upstream end of the flow path for the liquid to be heated, wherein each free end of the blades of the impeller is in contact with the inner wall surface of the first quartz glass tube so that the core tube is positioned inside the first quartz glass tube in a coaxial manner.

The insertion of the core tube of the hollow quartz glass tube in the first quartz glass tube makes it possible to enlarge the outer diameter of the flow path formed in the first quartz glass tube so that the heat transferring surface area can be increased, and narrowing the cross-sectional area of the flow path for the liquid to be heated while the flow velocity of the liquid can be increased. In addition, the provision of the impeller fixed to the core tube transforms the flow of the liquid into a spiral flow, so that the flow velocity of the liquid can be further increased. Accordingly, the flow velocity of the liquid passing in the flow path can be easily increased to more than 3,000 in the Reynolds number which causes a turbulent flow, and the heat transfer function can be progressively increased.

Since the impeller fixes the core tube to the center of the first quartz glass tube, the core tube can be held without deflection due to the liquid flowing in the flow path; the thickness of the flow path for the liquid to be heated, formed between the first quartz glass and the core tube can be uniformly maintained, and heat transfer from the inner surface of the tubular ceramic heater can be uniformly and effectively performed.

It is preferable that the upstream end of the core tube is formed to be a semi-spherical or to have a stream line so that the liquid to be heated can flow uniformly and resistance to the flow does not become large.

In another preferred embodiment of the liquid heating apparatus of the present invention, the distances between the surfaces of the tubular ceramic heater and both of the surface of the first and second quartz glass tubes disposed in the vicinity of the surfaces of the tubular ceramic heater are 1.2 mm or less. Namely, there are gaps between the surfaces of the tubular ceramic heater and the surfaces of the first and second quartz glass tubes, said gaps normally forming air layers. The thickness of the air layers are preferably 1.2 mm or less because the thinner the air layers are, the better the heat transfer is.

Although the thickness of the air layers can be reduced to 0.1 mm by increasing the roundness of the inner and outer circumferential surfaces of the tubular ceramic heater and the roundness of the wall of the flow path for the liquid to be heated, i.e., the quartz glass tube, the thickness of the air layers are preferably in a range from 0.3 mm to 1.0 mm in consideration of labor needed for processing the materials. It is possible to adjust the heat transfer balance from the inside and the outside of the tubular ceramic heater by adjusting the thickness of the air layers. The thermal conductivity of the air layers is small. Accordingly, the heat transfer can be further improved if consideration is made to improve the heat transferring function of these layers. For instance, it is an effective way to put the liquid heating apparatus in a container filled with helium gas, and the air layers are substituted with helium gas layers.

In a case of heating a single kind of liquid, it is preferable to connect flow paths which are disposed at the inside and the outside of the tubular ceramic heater in series by means of a connecting tube because a large heat transferring ability is obtainable by increasing the flow velocity of the liquid in the flow paths, and makes it easy to heat the liquid to be heated to a high temperature.

Further, if the liquid to be heated having a low temperature is first passed to the flow path outside the tubular ceramic heater, and then, the liquid heated to a elevated temperature is passed in the flow path inside the heater, the temperature of the outside portion of the liquid heating apparatus can be maintained at a low level and heat dissipation from the liquid heating apparatus is small, whereby the thermal efficiency can be improved.

It is, of course, an effective way to cover the outside of the third quartz glass tube with an insulating material.

In another preferred embodiment of the liquid heating apparatus of the present invention, spacers are disposed between the tubular ceramic heater and the first or the second quartz glass tube and at positions near both ends of the tubular ceramic heater, and the length in the axial direction of the heat generating portion of the tubular ceramic heater is shorter than the length of the outside flow path for the liquid in the same direction, wherein the heat generating portion of the tubular ceramic heater is completely surrounded by the flow paths for the liquid to be heated and the spacers do not overlap with the heat generating portion of the heater.

Electrode portions at the both ends of the tubular ceramics heater are so formed that their electric resistance is smaller than that of the heat generating portion. For instance, silicon is impregnated in the electrode portions or aluminum is flame-sprayed on the surface of the electrode portions so as to minimize heat generation. Lead wires are connected to the electrode portions to supply power from a power source.

In the above-mentioned structure wherein the almost all heat generating portion of the tubular ceramic heater is surrounded by the flow paths for the liquid to be heated which are formed of the quartz glass tubes, and the spacers are disposed not to overlap with the heat generating portion of the tubular ceramic heater, overheating of the tubular ceramics heater resulted from the spacers having an insulating property can be prevented, whereby the durability of the heater is assured and heat loss from the over-heating portion can be avoided.

For the spacers, a tape or a ribbon having heat resistance and electric insulating properties prepared by, for instance, weaving monofilaments of E glass or quartz glass is preferably used. Such a tape is wound in a ring shape on the first quartz glass tube or the tubular ceramic heater at positions near the ends of them, and the tubular ceramic heater or the second quartz glass tube is fitted to the above-mentioned first quartz glass tube or the tubular ceramic heater at a position outside the tape. The spacers perform such functions that the distance between the surface of the respective quartz glass tubes and the surface of the tubular ceramic heater can be maintained to a predetermined and uniform dimension, wherein movement displacement of the tubes due to the thermal expansion difference can be absorbed, partial overheating or uneven temperature distribution or a partial boiling phenomenon of the liquid to be heated which is caused due to uneven heat transferring can be avoided, and the durability of the tubular ceramic heater can be maintained.

The liquid heating apparatus of the present invention has the flow paths for the liquid to be heated, which are isolated by the quartz glass tubes, at the inside and outside of the tubular ceramic heater. Accordingly, simultaneous heating of different kinds of liquid to be heated can be performed by the liquid heating apparatus having a simple structure by feeding the different kinds of liquid to the flow paths separately.

A liquid heating apparatus having a large heating capacity can be obtained by connecting a plurality of the above-mentioned liquid heating apparatuses in series or in parallel.

In another preferred embodiment of the present invention, the temperature sensor is a sheathed thermocouple which is extended in a narrow tube of quartz glass disposed in the direction perpendicular to the axis of the tubular ceramic heater so as to penetrate the walls of the second and third quartz glass tubes and the flow path which are provided outside the tubular ceramic heater, wherein the free end of the sheathed thermocouple is inserted in a hollow formed in the surface of the tubular ceramic heater.

As the temperature sensor to measure the temperature of the tubular ceramic heater heated to about 600° C., the sheathed thermocouple is easy to use and convenient. If a relatively thin sheathed thermocouple is used, it can be inserted into a narrow gap. However, the gaps between the surfaces of the tubular ceramic heater and the surfaces of the first and second quartz glass tubes are narrow. When the sheath thermocouple is inserted into either gap, it is difficult to maintain the gap evenly.

In order to avoid such difficulty, for instance, a thin tube of quartz glass is formed integrally with the second and third quartz glass tubes so as to penetrate the walls of the second and third quartz glass tubes which surround the outer flow path and the flow path formed outside the tubular ceramic heater from the direction perpendicular to the central axis of the tubular ceramic heater, and a sheathed thermocouple is inserted to pass through the thin tube wherein the free end of the sheathed thermocouple is inserted in a hollow formed in the surface of the tubular ceramic heater, preferably at a position of or near the central portion.

Use of the quartz glass tube facilitates the fine working of the glass tubes. Further, it is easy to maintain the gap between the tubular ceramic heater and the quartz glass tubes to be narrow and uniform, and it is easy to conduct the attachment and replacement of the temperature sensor by arranging the sheathed thermocouple in such state.

In another preferred embodiment of the present invention, the liquid to be heated is purified water. The purified water (or ultra-purified water) is artificially purified water, or water which is highly purified by a chemical and physical means. As actual purification means, there are distillation, ion exchange, adsorption with active carbon, filtration with a membrane and so on.

In the following, the present invention will be explained by several Examples. However, the present invention is not limited to these Examples.

EXAMPLE 1

FIG. 1 is a cross-sectional view of a liquid heating apparatus 1 which is employed to heat a single kind of liquid. A tubular ceramic heater 4 is formed by the processes as follows. To a metal oxide consisting of a mixture of borosilicate glass and "KIBUSHI" clay containing 28% by weight of $Al_2O_3$, 67% by weight of $SiO_2$, 5% by weight of $Fe_2O_3$ and other impurities, silicon powder is added so that the free silicon content is 35% by weight to thereby obtain a mixture, followed by adding methylcellulose as a binder. Further, water is added to the mixture to prepare a kneaded batch. The kneaded batch is extruded into a tubular form. The thus obtained tube is dried and cut, followed by sintering at 1,350° C. for 4 hours in a reducing atmosphere. Since the metal oxide may contain a certain amount of iron, ferrosilicon powder can be used for the silicon powder.

A flow path 2 formed inside the tubular ceramics heater is surrounded by a first quartz glass tube 5, and a flow path 3 outside the tubular ceramics heater is formed between a second quartz glass tube 6 and a third quartz glass tube 7.

Since the liquid heating apparatus is so constructed that infrared rays radiated from the heated tubular ceramic heater pass through the walls of the quartz glass tubes and reach the liquid to be heated flowing in the flow paths 2, 3, fairly good heat transfer can be obtained even through the tubular ceramic heater is not in contact with the quartz glass tubes provided that the liquid to be heated possesses a nature to absorb infrared rays.

A thin quartz glass rod 13 is spirally wound around the circumference of the second quartz glass tube 6 disposed just outer side of the tubular ceramic heater so that the liquid to be heated is spirally fed in the flow path 3. Further, the flow path 2 formed inside and the flow path 3 formed outside are connected by means of a connecting tube 14.

The liquid heating apparatus is preferably assembled by combining the quartz glass tubes in the first step and then inserting the tubular ceramic heater which have been prepared separately. However, it is also possible to insert the quartz glass tubes in the inside and outside of the tubular ceramic heater in the first step, and next to connect the quartz glass tubes by means of a connecting tube.

As an example, the liquid heating apparatus having the above mentioned structure was used for heating purified water wherein the tubular ceramic heater having an outer diameter of 20 mm, an inner diameter of 14 mm and a length of 300 mm, and a heating capacity of 10 kW when a voltage of 200 was applied was used. When purified water was introduced at a rate of 10 l/min from an inlet port 9 into the outside flow path 3 and next into the inside flow path 2, the water having a temperature of 30° C. was heated to 44.1° C. Effective thermal efficiency was more than 98%. In this case, no contamination of the purified water by the material constituting the flow paths could be detected.

EXAMPLE 2

Figure 2:
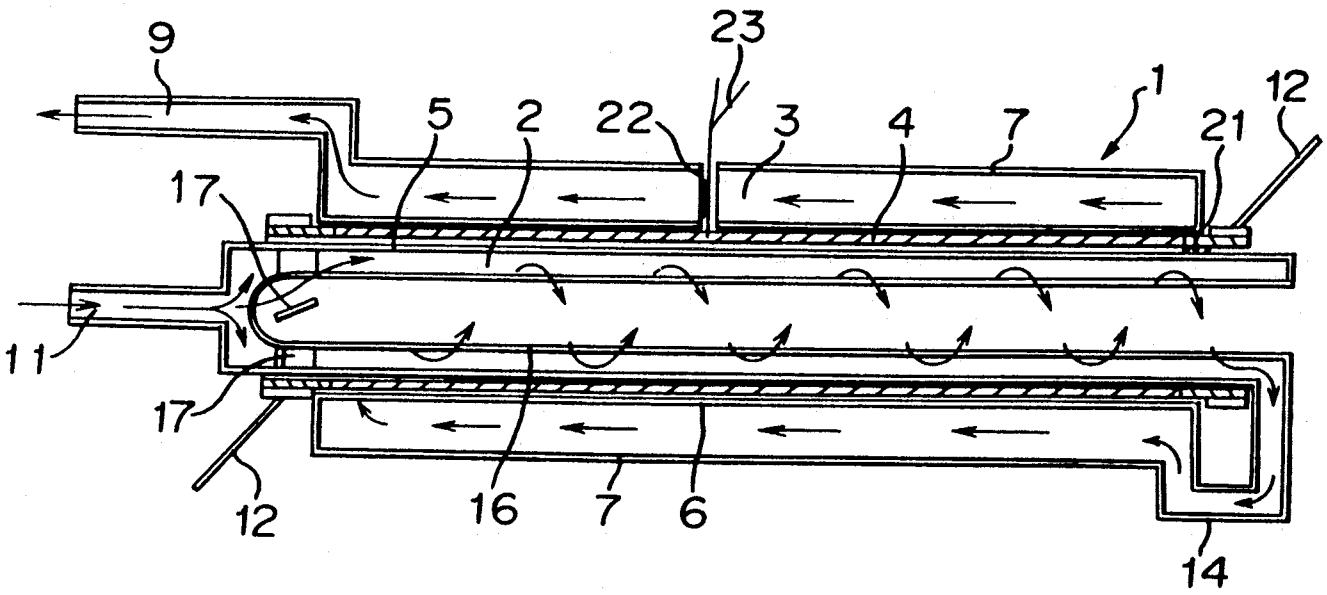
FIG. 2 is a cross-sectional view of another embodiment of the present invention.

FIG. 2 is a cross-sectional view of an embodiment of the liquid heating apparatus of the present invention, used for heating ultra-purified water which is used for washing intermediate products in manufacturing processes for electronics-related articles such as semiconductor devices.

The tubular ceramics heater 1 consists of the same material as that of Example 1, and the flow paths 2, 3 for the liquid to be heated, which are formed inside and outside the tubular ceramic heater, are entirely surrounded by very pure quartz glass which contains harmful impurities only at a level of 1 ppm. The thickness of the wall of each of the quartz glass tube is in a range of 1.5 mm–2 mm. The different point from Example 1 is that the diameter of the first quartz glass tube 5 disposed inside the tubular ceramic heater 4 is made larger so that the heat transfer surface are is made larger by the amount corresponding to the larger diameter. When the liquid to be heated is passed in the flow path having a circular cross section of the first quartz glass tube having a larger diameter, however, the flow velocity of the liquid becomes slow, whereby the heat transfer between the liquid to be heated and the first quartz glass tube 5 is poor and it is difficult to transfer heat to the liquid to be heated. In order to eliminate the above-mentioned disadvantage, a core tube 6 composed of a hollow quartz glass tube having an end portion around which an impeller 17 is fixed is inserted inside the first quartz glass tube 5 so that the cross-sectional area of the flow path 2 is made small and each free end of the impeller blades is in contact with the inside of the first quartz glass tube 5. Thus, the impeller 17 supports the core tube 6 so that the thickness of the flow path 2 having a ring-shaped cross-sectional area doesn't become uneven by the deflection of the core tube 6, or the core tube 16 is not moved by the pushing force of the flow of the liquid to be heated.

In this embodiment, the number of the blades of the impeller is three, and each of the blades is spirally inclined. Accordingly, a rotating force is imparted to the liquid flowing in the flow path and the Reynolds number is easily increased to above 3,000 by the acceleration of the flow velocity of the liquid, whereby the heat transfer can be further increased. In FIG. 2, the end face of the core tube 16 at the side of the impeller 17 is so formed as to have a hemispherical shape in order to uniform the flow of the liquid to be heated and to reduce the flow resistance.

Thus, there is obtainable the liquid heating apparatus having a large heating capacity wherein the inner diameter of the flow path 3 is made large by increasing the outer diameter of the flow path 2, whereby the outer diameter of the tubular ceramic heater is increased, hence, the heat transfer surface area is increased.

Onto the outer circumference at positions near the both ends of the first quartz glass tube 5, spacers 21 formed by winding ribbons, having a width of 10 mm, which are prepared by weaving quartz glass monofilaments, are attached. The tubular ceramics heater 4 is fitted to the outside of the spacers 21. The distance between the inner surface of the tubular ceramics heater 4 and the outer surface of the first quartz glass tube 5 is made uniform to have a dimension of about 0.5 mm by the spacers 21.

The dimensions of the tubular ceramic heater are 40 mm in outer diameter, 32 mm in inner diameter and 600 mm in length. An electrode portion having a length of 50 mm which doesn't substantially generate heat is formed to each end of the heater so as to reach 5 mm inside from each of the end edge of the flow path 3. Lead wires 12 are connected between the electrode portions and a power source (not shown).

Figure 3:
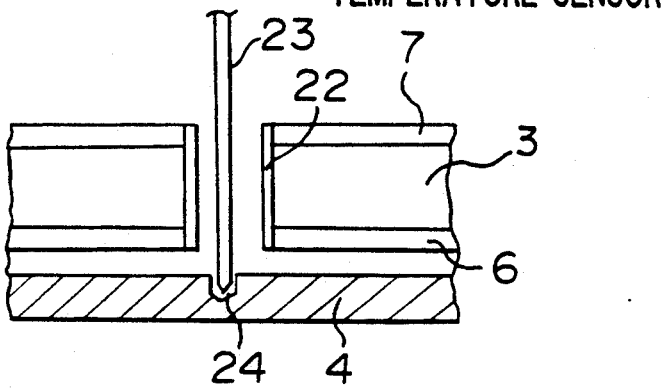
FIG. 3 is an enlarged cross-sectional view showing a sensor fitting part, shown in FIG. 2.

As shown in an enlarged view of FIG. 3, a thin quartz glass tube 22 is disposed at the central portion of the second quartz glass tube 6 and the third quartz glass tube 7 so as to penetrate the flow path 3 formed outside the tubular ceramic heater 4. A temperature sensor 23 of a sheathed thermocouple is inserted inside the thin tube 22, and the free end of the temperature sensor 23 of a sheathed thermocouple rests in a hollow 24 formed in the surface of the tubular ceramic heater 4.

The liquid heating apparatus having the above-mentioned construction allows direct detection of the temperature of the tubular ceramic heater 4 by the temperature sensor 23 and controls certainly the surface temperature of the tubular ceramic heater so as not to exceed the temperature which causes the devitrification of quartz glass.

The heating of purified water was tried with use of the liquid heating apparatus, wherein the tubular ceramics heater 4 with a heating capacity of 6 kW when a voltage of 200 V was applied was used. When purified water having a temperature of 20° C. was introduced through the port 11 at a flow rate of 10 l/min, the temperature of the purified water at the port 9 was 28.5° C. Effective thermal efficiency of this case was more than 98%. The temperature of the tubular ceramics heater 4 in use was 460° C. and the temperature of the electrode portion of the tubular ceramic heater was about 80° C.

Inspecting the contamination of the purified water discharged from the port 9, there is found no introduction of the contaminant.

EXAMPLE 3

Figure 4:
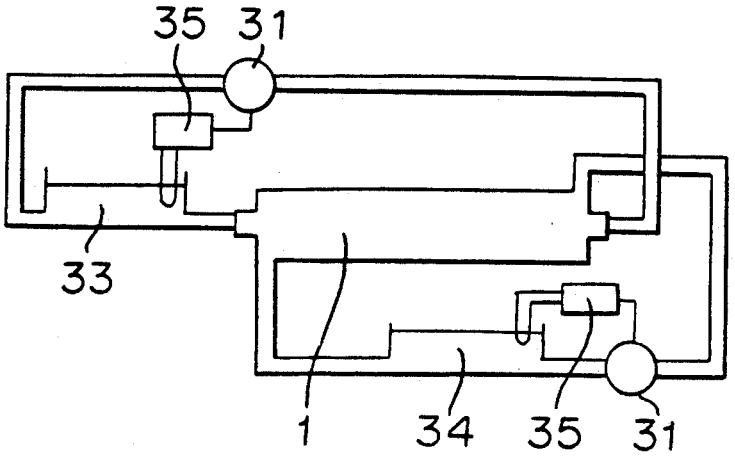
FIG. 4 is a diagram showing an example in which the liquid heating apparatus of the present invention is applied.

FIG. 4 is a diagram showing an embodiment of the liquid heating apparatus of the present invention, which is used to reserve temperature for a developing liquid and a fixing liquid for photograph.

In FIG. 4, reference numeral 1 designates a liquid heating apparatus main body, numeral 31 designates pumps, numeral 33 designates a developing liquid reservoir, numeral 34 designates a fix liquid reservoir and numeral 35 designates flow rate controllers for controlling revolution number of the pumps.

In this embodiment, the developing liquid and the fixing liquid is simultaneously heated without mixing in the single liquid heating apparatus having a simple structure; the temperature of the liquids is detected by means of temperature sensors attached to the developing liquid reservoir 33 and the fixing liquid reservoir 34; each of the revolution number of the pump 31 is regulated by each of the flow rate controller 35, and electric power to be supplied to the tubular ceramic heater is adjusted by a power controlling system (not shown) whereby the temperatures of the developing liquid and the fixing liquid are adjusted to predetermined temperatures.

The dimensions of the tubular ceramics heater used are 15 mm in outer diameter, 9 mm in inner diameter and 10 mm in length, which are prepared as follows. To a metal oxide powder mixture of alkali feldsper and clay containing 62% by weight of silica, 35% by weight of alumina and 3% by weight of other oxides, silicon powder is added so that the free silicon content is 20% by weight. Further, methylcellulose as a binder and water are added, and the mixture is kneaded. The kneaded batch is extruded and dried. Then, the dried product is sintered at 1,350° C. for 4 hours. When the tubular ceramics heater with a heating capacity of 300 W when it was connected to a 100 V a.c. power source was used for the liquid heating apparatus, the apparatus functioned to maintain about 1 l of developing liquid and about 1 l of fixing liquid, which are stored in their reservoirs at an arbitrary room temperature to 35° C. respectively. This liquid heating apparatus can be used for a developing liquid and a fixing liquid for a resist which is used in manufacturing processes of semiconductor devices.

EXAMPLE 4

Figure 5:
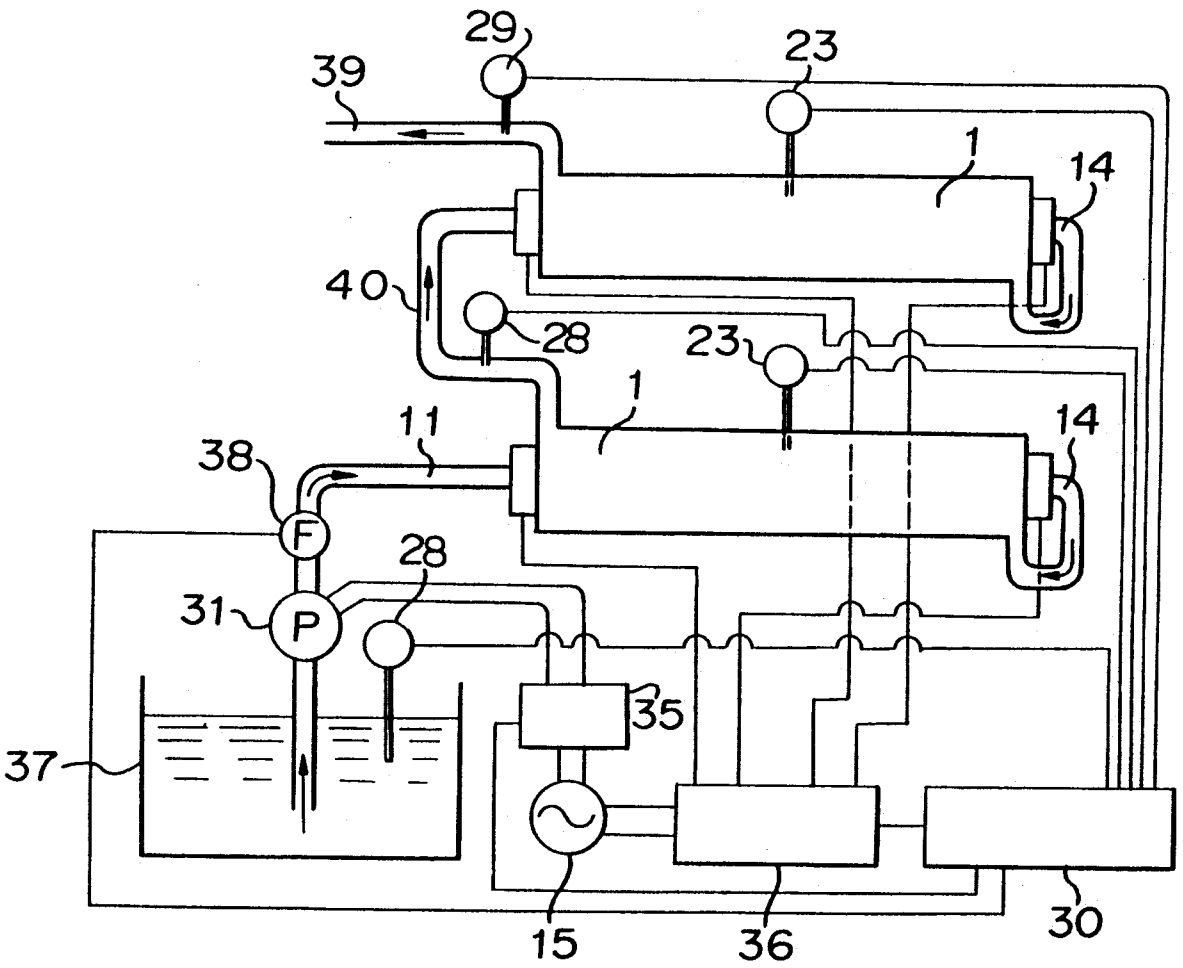
FIG. 5 is a diagram showing an embodiment of the liquid heating apparatus of the present invention in which an automatic control system is provided.

FIG. 5 is a diagram showing an embodiment of the liquid heating apparatus of the present invention used for heating purified water for washing the intermediate products of semiconductor devices.

In FIG. 5, reference numerals 1 designates liquid heating apparatus main bodies, numeral 15 designates a power source, numerals 23, 28, 29 designate temperature sensors, numeral 30 designates a controlling computer, numeral 31 designates a pump, numeral 35 designates a flow rate controller, numeral 36 designates a power controller, numeral 37 designates a purified water tank, numeral 38 designates a flow rate sensor, numeral 39 designates a discharge port and numeral 40 designates a pipe.

In this embodiment, purified water stored in the purified water tank 37 in the room temperature is supplied to two liquid heating apparatuses 1 connected in series via the flow rate sensor 38 by means of the pump 31, and the temperature of the purified water is raised to a predetermined temperature in the apparatuses. Then, the heated water is discharged through the discharge port 39. In this specified case, the flow rate of the purified water flowing in the flow paths is detected by the flow rate sensor 38 so that the flow rate is controlled to a predetermined level.

The temperature of the purified water in the purified water tank is detected by the temperature sensor 28, and a temperature signal from the temperature sensor 28 is stored as data in the memory of the controlling computer 30.

When the purified water begins to flow, a flow rate signal from a flow sensor 38 attached to feed pipe 11 is inputted into the controlling computer 30; electric power is supplied to the tubular ceramic heaters on the basis of a signal from the controlling computer 30; the temperature of the tubular ceramic heaters of the liquid heating apparatuses are detected by the temperature sensors 23, and the temperature signals from the temperature sensors 23 are also stored as data in the memory of the controlling computer. Further, a temperature sensor 28 is disposed at the pipe 40 between the liquid heating apparatuses and a temperature sensor 29 is disposed at the discharge port 39 for discharging heated water, and the temperature signals are supplied to the controlling computer so as to be stored as data in the memory. These data can be displayed on a display of the controlling computer, if needed.

The controlling computer determines temperatures of the tubular ceramic heaters of the liquid heating apparatuses to be maintained on the basis of the data collected, in accordance with a controlling program which is previously stored in the memory, whereby electric powers to be supplied from the power controller 36 are controlled so that the tubular ceramic heaters maintain the predetermined temperatures.

Thus, by controlling the temperatures of the tubular ceramic heaters of the liquid heating apparatuses, the temperature of the purified water discharged from the discharge port 39 can be rapidly controlled to a desired temperature.

In the depicted embodiment, two liquid heating apparatuses are connected in series. However, more number of the liquid heating apparatuses may be connected in series so that the heating capacity is increased.

A liquid heating apparatus having a large heating capacity was constructed by connecting in series 8 liquid heating apparatuses which had the same specification as that of Example 2, and purified water having a temperature of 20° C. was introduced into the connected liquid heating apparatus at a flow rate of 10 l/min. As a result, the temperature of the purified water discharged from the discharge port 39 could be maintained at 80° C. with an allowance of ±0.5° C. In this case, a controlling program was prepared for heating the purified water in such a manner that the temperature of each of the tubular ceramic heaters was kept to about 460° C. so as not to result large differences among the ceramic heaters of the 8 liquid heating apparatuses, and the fine adjustment of the purified water temperature was made by the liquid heating apparatus disposed at the final stage. In the above-mentioned example, the average electric power needed was 43 kW and the effective thermal efficiency was 97.3%. Inspection of contamination in the heated purified water discharged from the discharge port 39 was made, and no introduction of contaminant was found.

COMPARATIVE EXAMPLE

Figure 6:
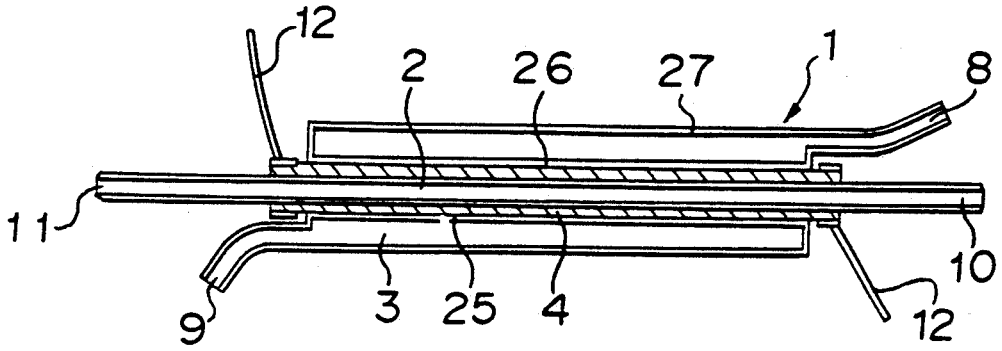
FIGURE 6 (PRIOR ART)
FIG. 6 is a diagram for a comparative example.
Figure 7B:
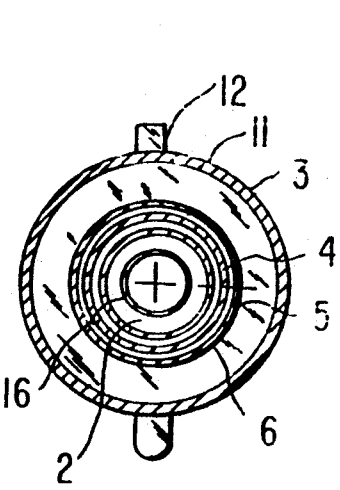
Figure 7A:
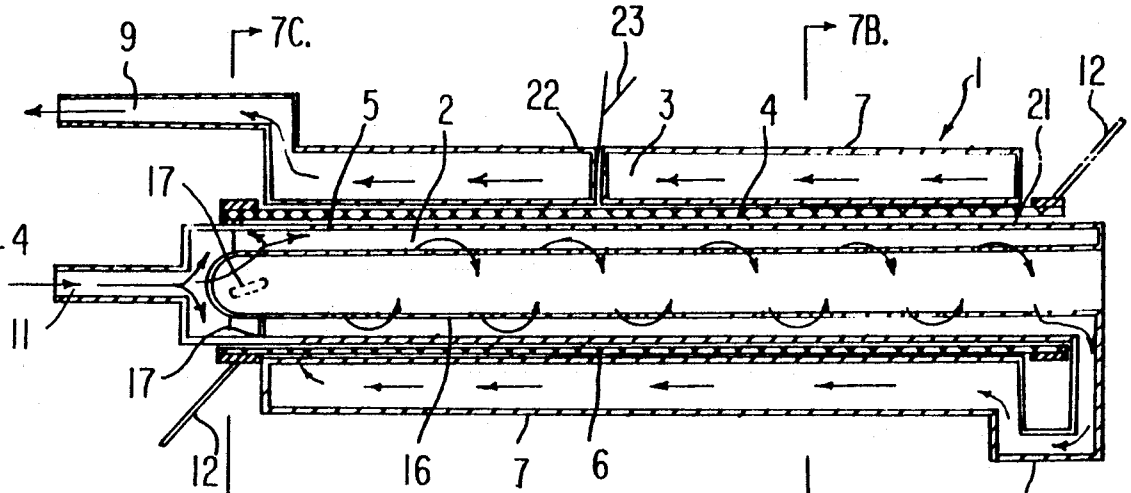
Figure 7C:
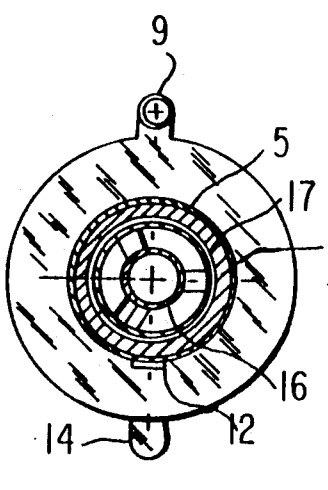

FIG. 6 is a cross-sectional view of a comparative example of the liquid heating apparatus 1 which has a tubular ceramic heater 4 formed of a material which contains 20% by weight of silicon and 80% by weight of a metal oxide comprising silica and alumina as the major components. The liquid heating apparatus further comprises a tube 25 made of polytetrafluoroethylene disposed inside the tubular ceramic heater 4 to thereby form a flow path 2 for the liquid to be heated, a tube 26 of polytetrafluoroethylene disposed outside the tubular ceramic heater 4 in contact with the heater, a tube 27 of polytetrafluoroethylene disposed in coaxial manner with and somewhat apart from the tube 26, and lead wires 12 connected to electrode portions in the tubular ceramic heater, wherein said tubes 26, 27 constitute a flow path 3 outside the tubular ceramic heater 4. In FIG. 6, reference numerals 10 and 11 designate inlet and outlet ports to the flow path 2, and numerals 8 and 9 designate inlet and outlet ports for the flow path 3 respectively.

The liquid heating apparatus having the above-mentioned construction is usable for heating various kinds of liquid including hydrofluoric acid, but was found to be difficult to constitute a liquid heating apparatus having a large heating capacity because the temperature of the tubular ceramics heater 4 could not be elevated above 300° C. Further, the liquid heating apparatus having the above-mentioned construction was unsuitable to heat purified water, especially to heat it to an elevated temperature, because a small amount of organic materials and small particles were discharged into the purified water.

In accordance with the present invention, there can be provided a liquid heating apparatus free from contamination to a liquid to be heated, having a compact shape and a high heat capacity, having a relatively simple structure while providing a high thermal efficiency, capable of simultaneously heating a plurality kinds of liquid for specified purposes, and requiring substantially no waiting time. These effects are obtained since quartz glass is used for the wall material of the flow paths, and heat from a tubular ceramic heater, which radiates a large amount of infrared rays, is transmitted to the liquid to be heated. By means of heat transfer which effectively utilizes both heat conduction and radiation heat transfer. The liquid heating apparatus is suitable for continuously heating purified water used for manufacturing electronics-related products, and is widely usable in industries.

What is claimed is:

1. A liquid heating apparatus comprising an electric resistance heating type ceramic heater having a tubular shape, first and second flow paths for flowing liquid to be heated, which are formed in the vicinity of the inside and the outside of said tubular ceramic heater respectively, wherein said first flow path for the liquid is surrounded by a first quartz glass tube which is disposed inside said tubular ceramic heater in a coaxial manner, and said second flow path for the liquid is formed between second and third quartz glass tubes which are disposed outside said tubular ceramic heater in a coaxial manner.

2. The liquid heating apparatus according to claim 1, wherein material for said tubular ceramic heater comprises free silicon and a metal oxide including alumina and silica as the major components, and the content of free silicon in the material is in a range from 5 to 50% by weight.

3. The liquid heating apparatus according to claim 1, wherein temperature regulation of the liquid to be heated is performed by controlling electric power by a controlling section which functions to maintain the temperature of said tubular ceramic heater at a predetermined temperature which corresponds to a desired elevated temperature of the liquid in response to temperature signals from a first temperature sensor attached to the inlet portion of the liquid and a second temperature sensor attached to said tubular ceramic heater and a flow rate signal from a flow sensor disposed at a feed pipe of the liquid.

4. The liquid heating apparatus according to claim 1, wherein a hollow core tube of quartz glass is inserted in the first quartz glass tube which is disposed inside the tubular ceramics heater, and an impeller is fixed to the circumference of said core tube at a position near its upstream end of the flow path for the liquid to be heated, and the free ends of the blades of the impeller are in contact with the inner wall surface of the first quartz glass tube so that the core tube is positioned inside the first quartz glass tube in a coaxial manner.

5. The liquid heating apparatus according to claim 1, wherein the distance between the surfaces of the tubular ceramic heater and both of the surfaces of said first and second quartz glass tubes which are disposed in the vicinity of the surface of the tubular ceramic heater are 1.2 mm or less.

6. The liquid heating apparatus according to claim 1, wherein the flow paths formed at the inside and the outside of said tubular ceramics heater are connected in series through a connecting tube.

7. The liquid heating apparatus according to claim 1, wherein spacers are disposed between the tubular ceramic heater and the first or the second quartz glass tube at positions near both ends of said tubular ceramics heater, and the length in the axial direction of the heat generating portion of the tubular ceramic heater is shorter than the length of the outside flow path for the liquid in the same direction, wherein the heat generating-portion of the tubular ceramic heater is completely surrounded by the flow path for the liquid, and said spacers are disposed so as not to overlap with the heat generating portion which is formed at an intermediate portion of said tubular ceramics heater.

8. The liquid heating apparatus according to claim 3, wherein said second temperature sensor is a sheathed thermocouple extending in a narrow tube of quartz glass, and its free end is inserted in a hollow formed in the outer surface of said tubular ceramic heater, said narrow tube of quartz glass being extended to penetrate the second and third quartz glass tubes which surround the second flow path formed outside said tubular ceramic heater and said second flow path formed between said second and third quartz glass tubes in the direction perpendicular to the axis of said tubular ceramic heater, and said narrow tube being integrally attached to said second and third quartz glass tubes.

9. The liquid heating apparatus according to claim 1, wherein said liquid to be heated is purified water.

* * * * *